US011712776B2

(12) United States Patent
Sullivan et al.

(10) Patent No.: US 11,712,776 B2
(45) Date of Patent: Aug. 1, 2023

(54) ROTOR POLISHING DEVICE

(71) Applicants: Terry Sullivan, Borger, TX (US); Casey Sullivan, Borger, TX (US); Stacie Armes, Gruver, TX (US)

(72) Inventors: Terry Sullivan, Borger, TX (US); Casey Sullivan, Borger, TX (US); Stacie Armes, Gruver, TX (US)

( * ) Notice: Subject to any disclaimer, the term of this patent is extended or adjusted under 35 U.S.C. 154(b) by 782 days.

(21) Appl. No.: 16/267,060

(22) Filed: Feb. 4, 2019

(65) Prior Publication Data

US 2019/0240800 A1 Aug. 8, 2019

Related U.S. Application Data

(60) Provisional application No. 62/625,508, filed on Feb. 2, 2018.

(51) Int. Cl.

| | |
|---|---|
| ***B24C 3/26*** | (2006.01) |
| ***B24C 3/28*** | (2006.01) |
| ***B24B 57/02*** | (2006.01) |
| ***B24B 37/02*** | (2012.01) |
| ***F04C 18/16*** | (2006.01) |
| ***F04C 29/00*** | (2006.01) |
| ***B24B 37/34*** | (2012.01) |
| ***B24B 27/033*** | (2006.01) |
| ***B24B 31/00*** | (2006.01) |
| ***F04C 18/08*** | (2006.01) |

(52) U.S. Cl.

CPC ..... *B24B 37/02* (2013.01); *B24B 27/033* (2013.01); *B24B 31/003* (2013.01); *B24B 37/345* (2013.01); *B24B 57/02* (2013.01); *B24C 3/26* (2013.01); *B24C 3/28* (2013.01); *F04C 18/084* (2013.01); *F04C 18/16* (2013.01); *F04C 29/0092* (2013.01); *F04C 2230/92* (2013.01)

(58) Field of Classification Search

CPC ... B24B 31/003; B24B 31/02; B24B 31/0224; B24B 31/03; B24B 31/064; B24B 37/02; B24B 37/025; B24B 37/345; B24B 57/02; B24C 3/26; B24C 3/28

USPC ..... 451/32, 35, 38, 82, 85, 326, 328

See application file for complete search history.

(56) References Cited

U.S. PATENT DOCUMENTS

| | | | | |
|---|---|---|---|---|
| 2,495,269 | A * | 1/1950 | Lindmark | B24C 3/06 451/82 |
| 4,173,851 | A * | 11/1979 | Higashi | B24B 31/003 451/113 |
| 4,361,989 | A * | 12/1982 | Ohno | B24B 31/003 451/328 |
| 4,439,121 | A | 3/1984 | Shaw | |
| 4,615,145 | A * | 10/1986 | Matsumoto | B24B 31/003 451/106 |
| 5,411,387 | A | 5/1995 | Lundin et al. | |
| 6,027,322 | A | 2/2000 | Ferentinos et al. | |

(Continued)

FOREIGN PATENT DOCUMENTS

| | | | | |
|---|---|---|---|---|
| GB | 1067656 | A * | 5/1967 | B24B 31/003 |

*Primary Examiner* — Eileen P Morgan

(74) *Attorney, Agent, or Firm* — Boudwin Intellectual Property; Daniel Boudwin

(57) ABSTRACT

A rotor polishing device, including a housing with a space therein for holding rotors in need of polishing, an inlet for pumping a polishing lapper into the housing, and a rotational assembly for rotating the rotors during the polishing process. The rotor polishing device is useful for polishing rotors commonly used by rotary screw compression systems.

12 Claims, 5 Drawing Sheets

(56) References Cited

U.S. PATENT DOCUMENTS

| | | | | |
|---|---|---|---|---|
| 6,280,303 | B1 * | 8/2001 | Kawasaki | B24B 31/003 451/104 |
| 6,688,868 | B2 | 2/2004 | Segers et al. | |
| 6,962,522 | B1 * | 11/2005 | Kawasaki | B24B 31/003 451/104 |
| 7,217,173 | B1 * | 5/2007 | Yan | B24B 19/022 451/104 |
| 7,614,862 | B2 | 11/2009 | Heggen et al. | |
| 8,100,027 | B2 * | 1/2012 | Sato | C21D 9/32 74/460 |
| 8,556,683 | B2 * | 10/2013 | Lynn | B24C 3/02 451/89 |
| 9,511,469 | B2 * | 12/2016 | Boon Beng | B24B 31/003 |
| 10,357,866 | B2 * | 7/2019 | Wolk | B24B 31/006 |
| 2005/0186889 | A1 * | 8/2005 | McNeil | B24B 31/003 451/36 |
| 2007/0107217 | A1 * | 5/2007 | Baus | B24B 31/073 29/889.1 |
| 2014/0199923 | A1 * | 7/2014 | Gegenheimer | B24B 41/061 451/106 |
| 2019/0329375 | A1 * | 10/2019 | Kuo | B24B 47/12 |

* cited by examiner

ROTOR POLISHING DEVICE

CROSS REFERENCE TO RELATED APPLICATIONS

This application claims the benefit of U.S. Provisional Application No. 62/625,508 filed on Feb. 2, 2018. The above identified patent application is herein incorporated by reference in its entirety to provide continuity of disclosure.

BACKGROUND OF THE INVENTION

The present invention relates to polishing of rotary screws for a rotary screw compressor. More particularly, the present invention provides a device that can polish a set of rotary screws.

Rotary screw compressors must be carefully maintained and polished to ensure proper functionality. Typically, rotary screw compressors are manually disassembled and cleaned by an individual. Industrial mechanics who overhaul screw compressors must frequently clean away debris and smooth rotary screws by hand, which may take several days. During this extensive process, the rotary screw compressor is out of commission. If the screw compressor is not properly cleaned and maintained, then the rotors, bearings, and other components may fail. This may cause rotors to rub together during operation, which can dramatically reduce the operating life of the rotors.

Consequently, there is a need for an improvement in the art of polishing rotary screws for rotary screw compressors. The present invention substantially diverges in design elements from the known art, and solves a problem faced in the rotary screw compressor industries. In this regard, the present invention substantially fulfills these unmet needs.

SUMMARY OF THE INVENTION

The present invention provides a polishing device for rotary screws found in rotary screw compressors, wherein the same can be utilized for providing convenience to an individual tasked with polishing and cleaning these rotors. The present system comprises a machine to polish rotors found in rotary screw compressors.

Other objects, features and advantages of the present invention will become apparent from the following detailed description taken in conjunction with the accompanying drawings.

BRIEF DESCRIPTION OF THE DRAWINGS

Although the characteristic features of the invention will be particularly pointed out in the claims, the invention itself and the manner in which it may be made and used may be better understood after a review of the following description, taken in connection with the accompanying drawings, wherein like numeral annotations are provided throughout.

DETAILED DESCRIPTION OF THE INVENTION

Figure 1:
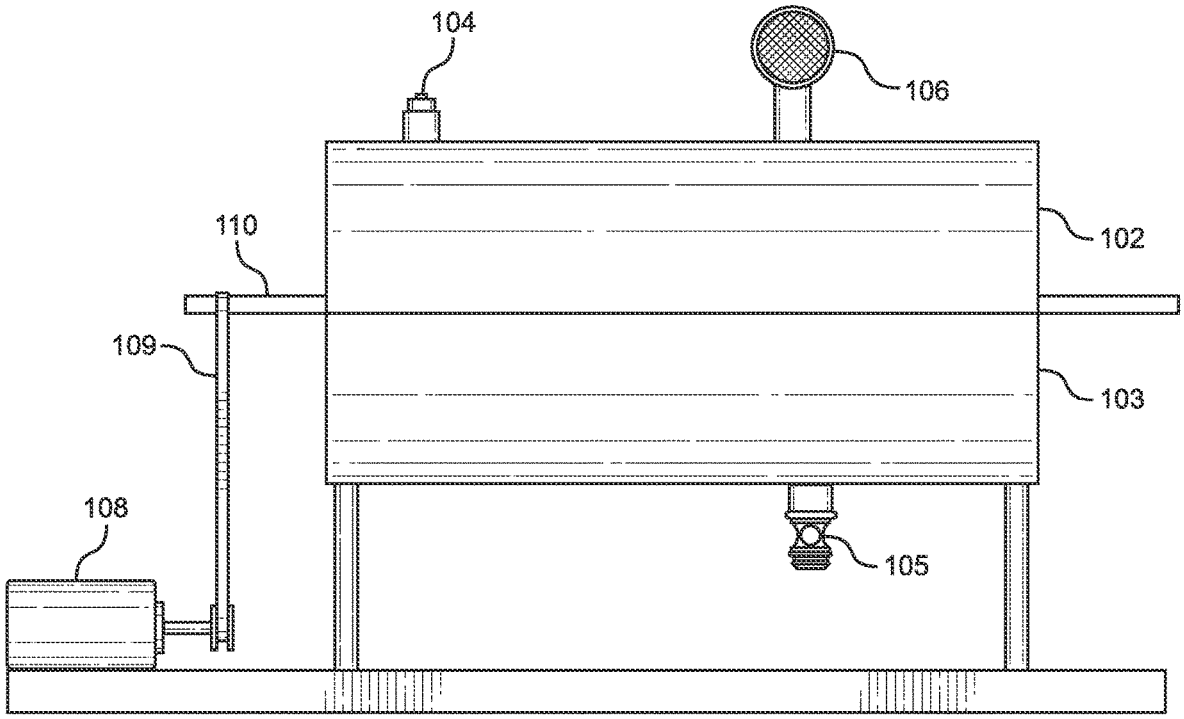
FIG. 1 shows a front view of an embodiment of a rotor polishing device.

Reference is made herein to the attached drawings. Like reference numerals are used throughout the drawings to depict like or similar elements of the rotor polishing device. For the purposes of presenting a brief and clear description of the present invention, an embodiment of the rotor polishing device will be discussed. The figures are intended for representative purposes only and should not be considered to be limiting in any respect.

Referring now to FIG. 1, there is shown a front view of an embodiment of a rotor polishing device. In the embodiment, a polishing tank includes a top section 102 and a bottom section 103, forming a housing. This housing can transition from an open configuration to a closed configuration, generally accomplished by disengaging, wholly or partly, the top section 102 from the bottom section 103. When the sections 102 and 103 are together in the closed configuration, they may be locked into place. In this manner, the housing may be opened to place a rotor therein, and closed to perform a method of cleaning the rotor using the device. This can be done in any number of ways, for example but not limited to the top section can be completely removed from the bottom section, or there can be a hinge attachment holding the two sections together, in another embodiment the top section can slide away from the bottom section. In the event of a big rotor needing to be placed in the polisher it may be easier for the top to come completely off of the polisher. When smaller rotors are used the top may hinge in order to be easier to handle for a user. A rail system maybe put in place to allow the top to slide away from the bottom section while still being attached. This sliding configuration could make it easier for a user to remove the top.

When the sections are together in the closed configurations they may be locked into place. This locking can be done by any manner of screws and bolts, ratchets, latches, buckles, or other manners of securing the two sections in a closed position. In an embodiment a screw and bolt system used as a manner of locking the top portion and the bottom portion together. The system can be placed in any number of configurations such that when tightened down the two portions are secured together. Using this system will allow a user to decide how much to tighten the screws.

In the shown embodiment, the housing includes two valves attached thereto (104, 105). An input valve 104 is attached to the top section 102, and a drain valve 105 is attached to the bottom section 103. The input valve 104 enables lapper to be transferred into the housing after the housing has been sealed, and the drain valve 105 enables lapper to be drained out of the housing during or after performing the method of cleaning the rotor using the device.

As used herein, lapper is a mixture used to sharpen or polish the rotor. Lapper may be a mixture of water and sand or other polishing materials. Different materials will provide for a faster or slower polish. In some cases, different materials will be necessary for rotors made of stronger materials. Lapper may come in a variety of grades with various grit ratings. The smaller the grit the more of a polish will be applied to the rotor. In a typical polishing process various lapper will be used and go from a low grit rating or a bigger grit to a high grit rating or smaller grit. Further, water or oil may be used in the lapper mix depending on the grit that is purchased. For example, certain products require water to be properly mixed. One of ordinary skill in the art will understand that these descriptions are not limiting and that any commercially available lapper product will work with various embodiments.

In the shown embodiment, a vent 106 is attached to the top section 102. The vent 106 is configured to allow air to escape the housing as the housing is filled with the lapper. In this manner, the vent 106 helps alleviate pressure and acts as a safety feature when operating the polishing device.

In the shown embodiment, a motor 108 is attached via a belt drive 109 to a rod 110 that enters the housing. The motor 108 can be a variable speed motor operable at any of a plurality of speeds. The motor 108, when operated, causes the rod to rotate, which allows for one or more rotors in the housing to be rotated at a particular speed. For example, the one or more rotors can be spun slower when using a large grit lapper, and faster when using a small grit lapper. In this manner, the method of cleaning the one or more rotors can be customized according to a particular need.

Further the motor can be a motor that is capable of spinning both the belt drive in both forwards and reverse. This can allow for the rotors to spin in both directions making sure that there is an even polish. Further, this functionality can be used in the event that the rotors become jammed or clogged with lapper.

Figure 2:
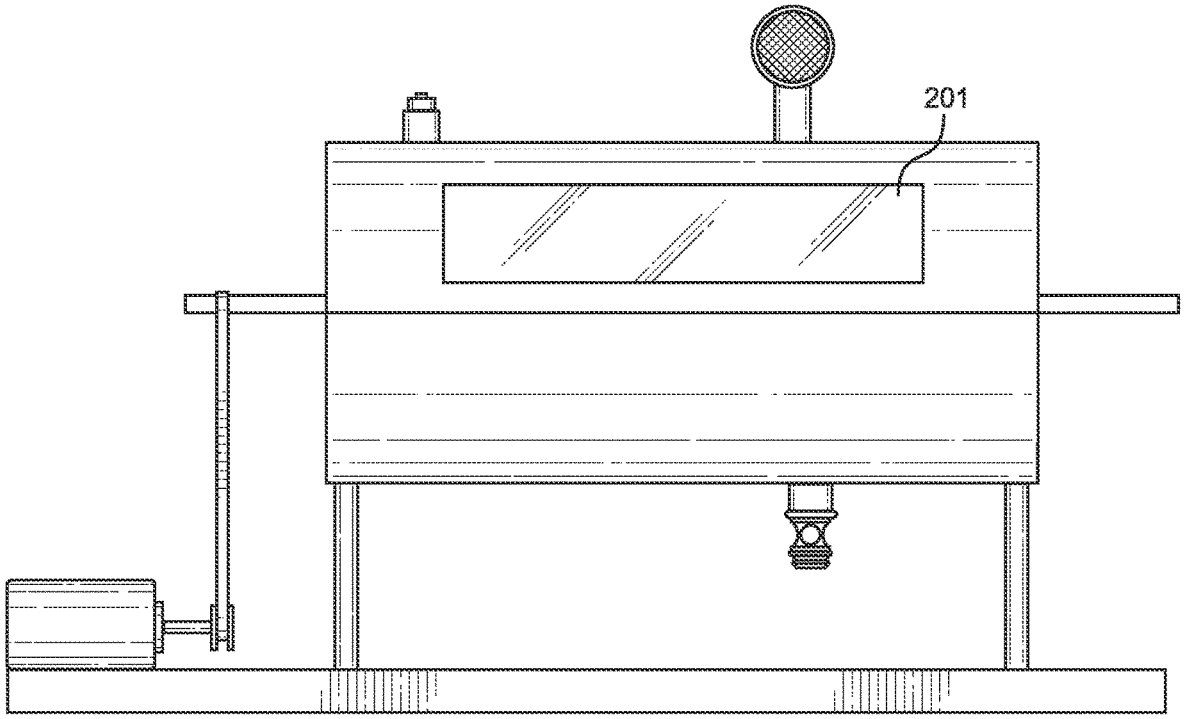
FIG. 2 shows a front view of an embodiment of the rotor polishing device with a window positioned on a polishing tank.

Referring now to FIG. 2 there is shown a front view of an embodiment of the rotor polishing device with a window positioned on the housing. A window 201 enables an operator to monitor the one or more rotors as they are polished, or easily determine the amount of lapper in the housing. In this manner, the operator can easily know if there is a potential problem or if something needs adjusted. The window may be attached in such a manner that there is an airtight seal or waterproof seal. In this manner, the lapper is prevented from leaking out of any spaces between the window and the housing.

Figure 3:
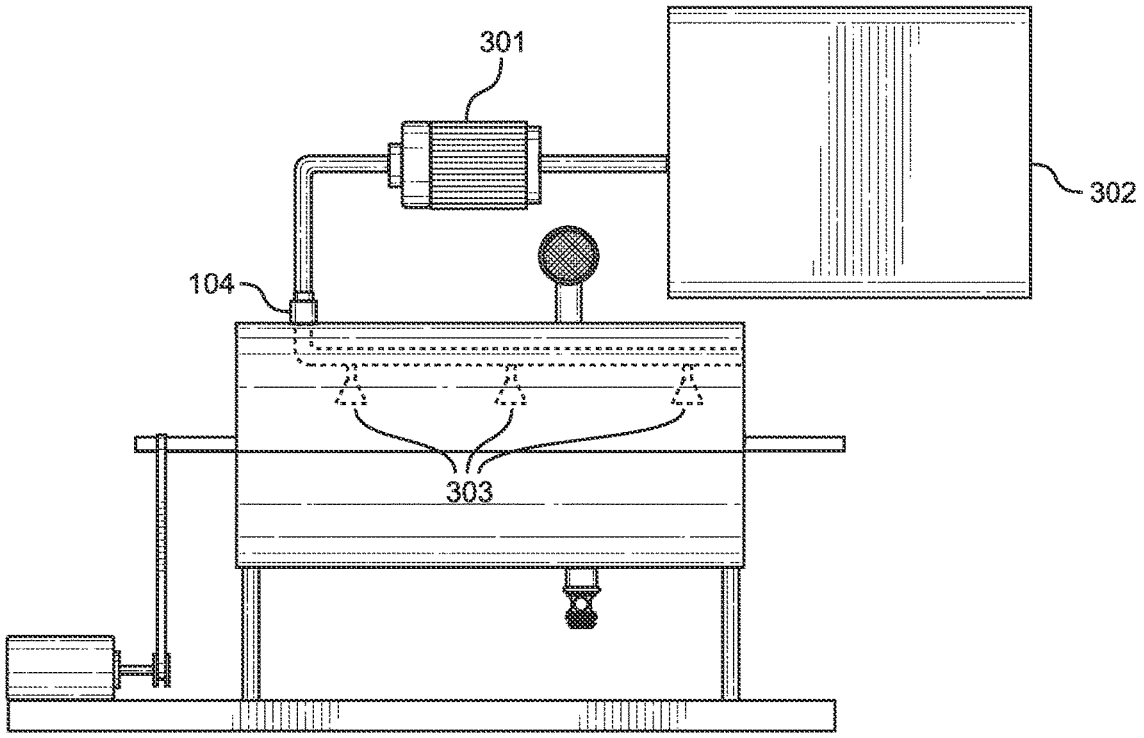
FIG. 3 shows a front view of an embodiment of the rotor polishing device, wherein the rotor polishing device includes a lapper pump and a lapper tank fluidly connected to an inlet of the polishing tank.
Figure 4:
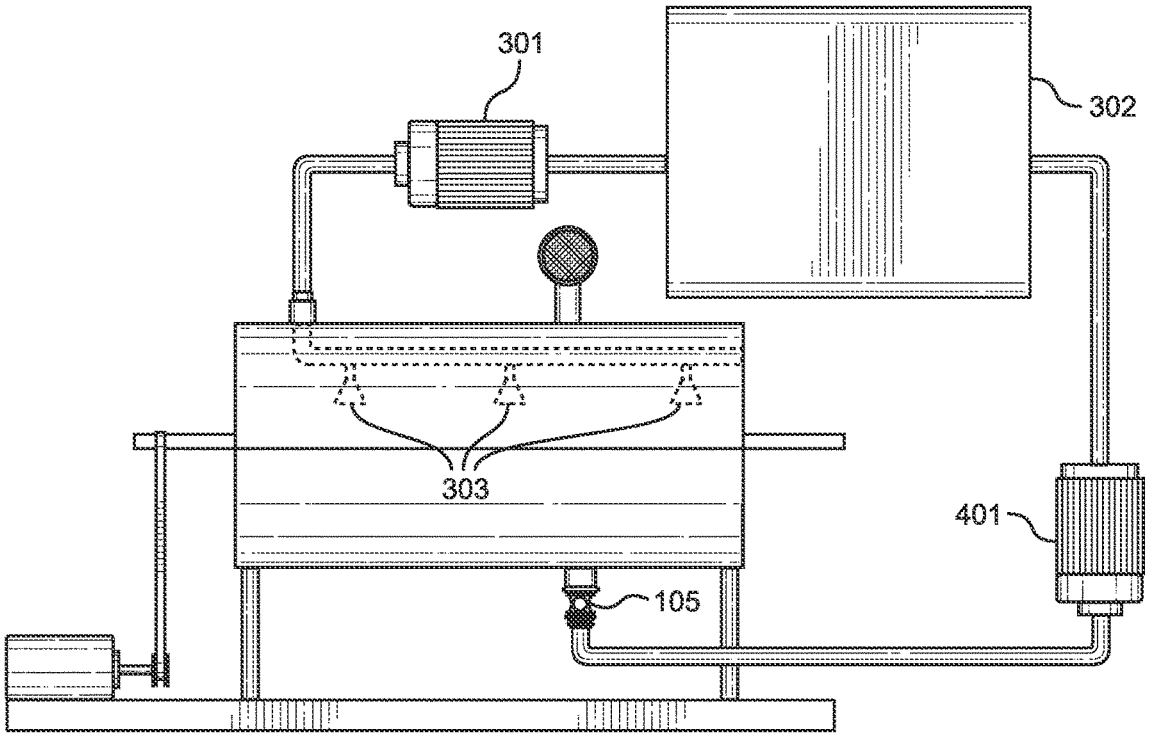
FIG. 4 shows a front view of an embodiment of the rotor polishing device, wherein the rotor polishing device further includes a second lapper pump connected from an outlet of the polishing tank to the lapper tank.

Referring now to FIGS. 3 and 4, there are shown a front view of an embodiment of the rotor polishing device, wherein the rotor polishing device includes a first lapper pump and a lapper tank fluidly connected to an inlet of the housing, and a front view of an embodiment of the rotor polishing device, wherein the rotor polishing device further includes a second lapper pump connected from an outlet of the housing to the lapper tank, respectively. In these embodiments, the polishing device includes a first lapper pump 301 and a lapper tank 302 attached to the housing (FIG. 3), and further may include a second lapper pump 401 configured to return lapper to the lapper tank 302 (FIG. 4). In this manner, lapper may be actively pumped into the housing for use (FIG. 3, FIG. 4), and may also be returned to the lapper tank 302 for recycling of the lapper (FIG. 4).

In the shown embodiment, the first lapper pump 301 is fluidly connected to the input valve 104 (FIG. 3). In the shown embodiment, the first lapper pump 301 is able to pump fluids or a combination of fluids and solid particles. In one embodiment, the first lapper pump 301 is able to pump lapper according to any of a plurality of fluid pressures. In this manner, the lapper may be applied to the one or more rotors at different rates or pressures.

Referring now to FIG. 4, the second lapper pump 401 is fluidly connected to the drain valve 105. The second lapper pump 401 may pump fluid or a mixture of fluid and solid particles. In one embodiment, the second lapper pump 401 may also be fluidly connected to the lapper tank 302 to return lapper from the housing to the lapper tank 302. This feature allows for the lapper to be saved or recycled, and returned to the lapper tank. This configuration allows for lapper to be continuously cycled through the housing throughout the polishing process. This can help keep temperatures down and allow for faster rotation of the rotors and faster polishing. Further, by cycling the lapper, the lapper may remain cleaner or may last longer.

In the embodiment shown in FIGS. 3 and 4, a at least one spray nozzle 303 is placed inside the housing, such that the spray nozzle 303 is fluidly connected to the input valve for distributing the lapper mixture onto the rotors. In the shown embodiment three spray nozzles 303 are utilized, however, alternative numbers of spray nozzles 303 may be utilized according to need. The spray nozzles 303 allow for lapper to be evenly applied across the rotors during the polishing process. In one embodiment, the spray nozzles 303 are positioned such that lapper is sprayed directly onto at least one rotor in the housing, and this configuration may be utilized to ensure that the rotors are covered and do not rub together dry, as this may damage the rotors.

Figure 5:
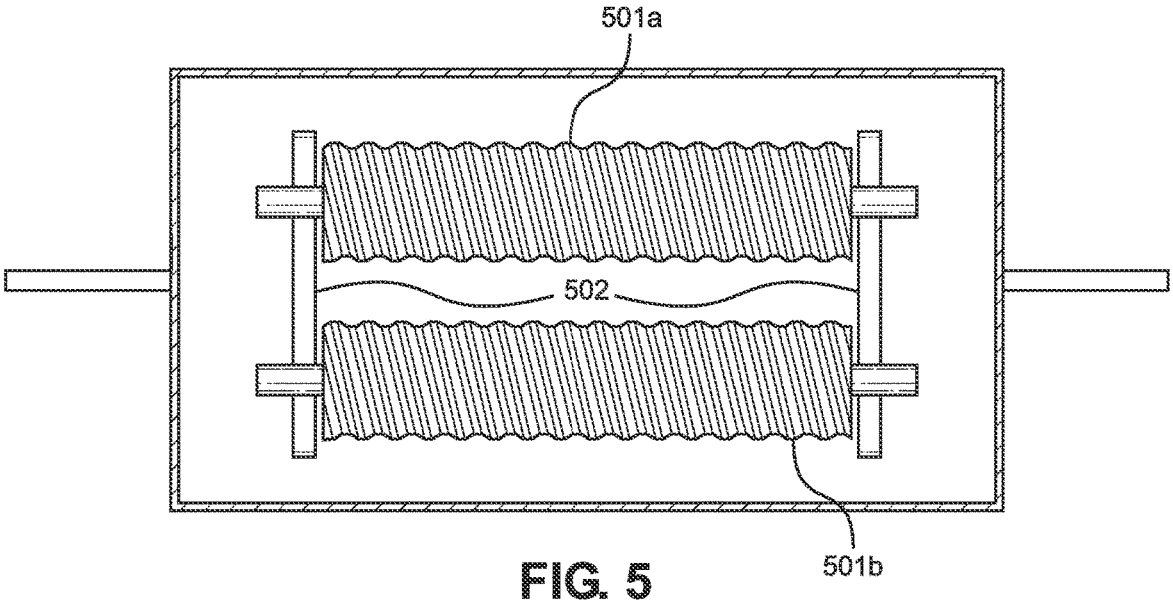
FIG. 5 shows a top down view of an embodiment of the polishing tank in an open configuration, wherein are two rotors placed in the polishing tank.

Referring now to FIG. 5, there is shown a top view of an embodiment of the housing in an open configuration, wherein there are two rotors placed in the housing. In the shown embodiment, two rotors 501*a*, 501*b* are positioned on set of tracks 502. The tracks 502 can be configured to allow various connections to be attached to the tracks 502. The connections can be attached to the tracks such that the rotors 501*a* and 501*b* can slide back and forth on the tracks. This allows for different spacing of rotors to allow for many different sizes of rotors to be used in the same polishing machine. When the connectors are placed on the track they can slide, however they can also be attached such that the operator can lock the connectors in place to ensure that the rotors maintain the proper placement throughout the polishing process. This will ensure that the rotors do not become loose and come in contact with each other, potentially breaking.

Figure 6:
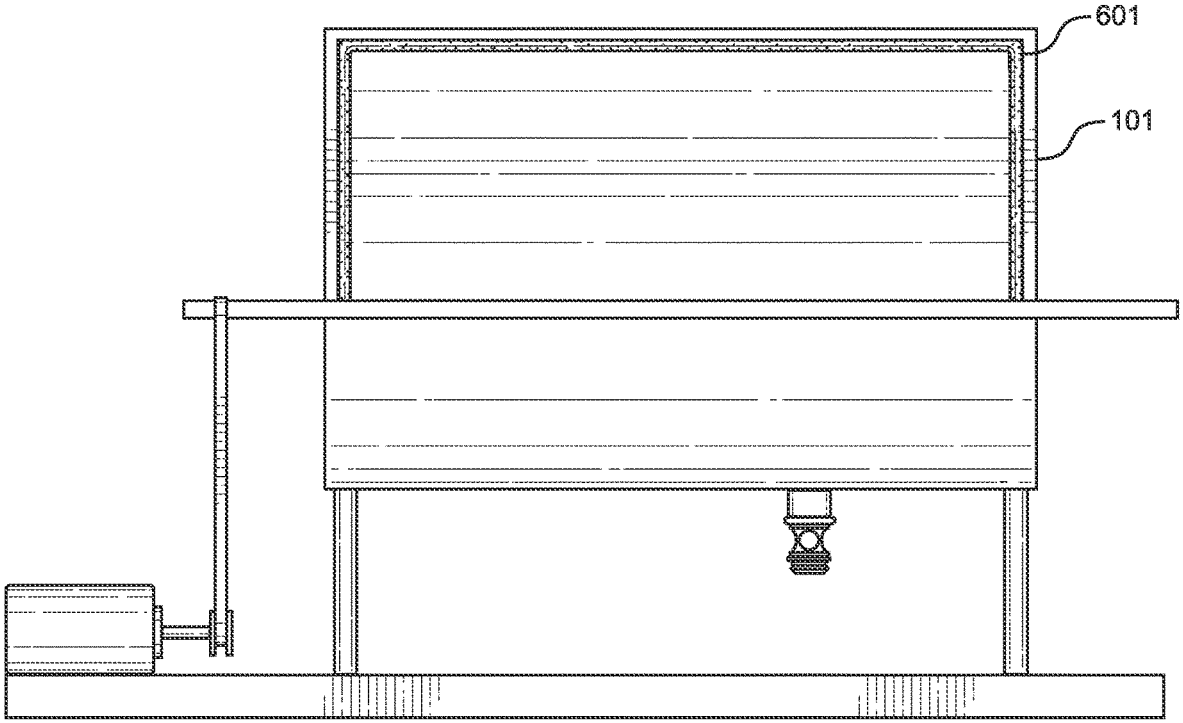
FIG. 6 shows a front view of the polishing tank in an open configuration, wherein the polishing tank includes a gasket or seal therein.

Referring now to FIG. 6, there is shown a front view of the polishing tank in an open configuration, wherein the polishing tank includes a gasket or seal therein. In the shown embodiment, a gasket or a seal 601 is placed around the top section 101. This may be one or more of an O-ring, a rubber guard, or any other manner of providing an air- or liquid-tight seal. In one embodiment, the gasket 601 creates a water proof seal when the housing is in the closed position. This prevents lapper from leaking out of the housing and creating a mess that can be dangerous to the operator.

Figure 7:
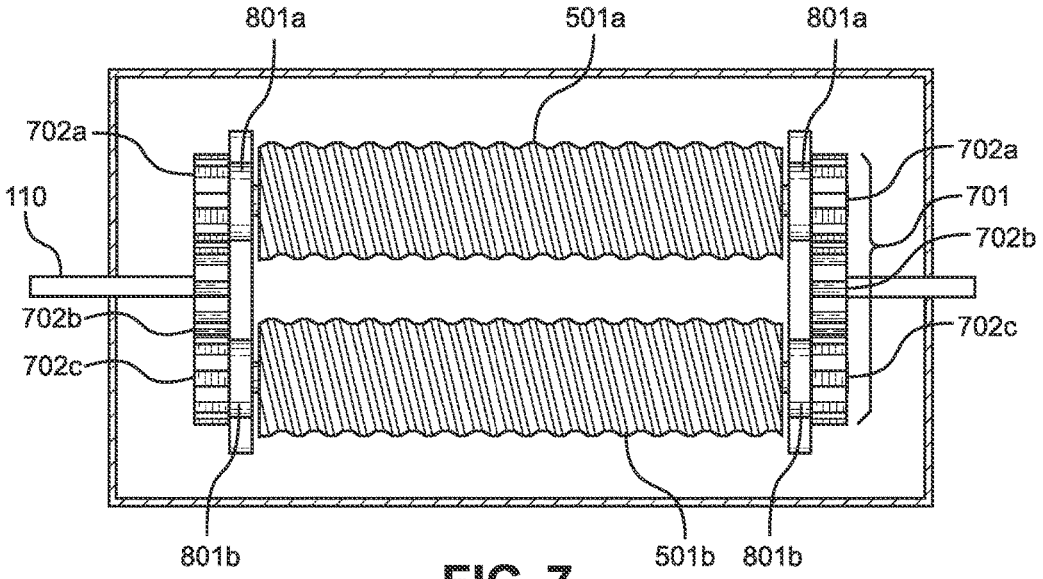
FIG. 7 shows a top down view of an embodiment of the polishing tank in the open configuration, with two rotors placed in the polishing tank, wherein the polishing tank includes a pair of gear assemblies operably coupled to the pair of rotors.

Referring now to FIG. 7, there is shown a top down view of an embodiment of the housing in the open configuration, with two rotors placed in the housing, wherein the housing includes a pair of gear assemblies 701 operably coupled to the pair of rotors 501*a*, 501*b*. In the shown embodiment, the rotors 501*a*, 501*b* are attached to a gear assembly 701 on each end of the rotors 501*a*, 501*b*. The gear assembly 701 is made up of three gears on each side 702*a*, 702*b*, 702*c* of the rotors 501*a*, 501*b*. This gear assembly 701 allows the rotors 501*a*, 501*b* to be attached to the motor by having one middle gear 702*b* operably coupled to the motor via the rod 110. Each gear assembly 701 engages the corresponding rotor 501*a*, 501*b* via an attachable gear 701*a*, 701*c* which is secured to the rotor 501*a*, 501*c* between the rod 703 and the bearings 801*a*, 801*b*. As such, the rod 110 will be driven by the motor (shown in FIG. 1) which will in turn rotate the middle gear 702*b*, in turn turning the attachable gears 702*a*, 702*c*, in turn turning the rotors 501*a*, 501*b*, which are rotatably secured to the tracks 502 via the bearing assemblies 801*a*, 801*b*.

Figure 8:
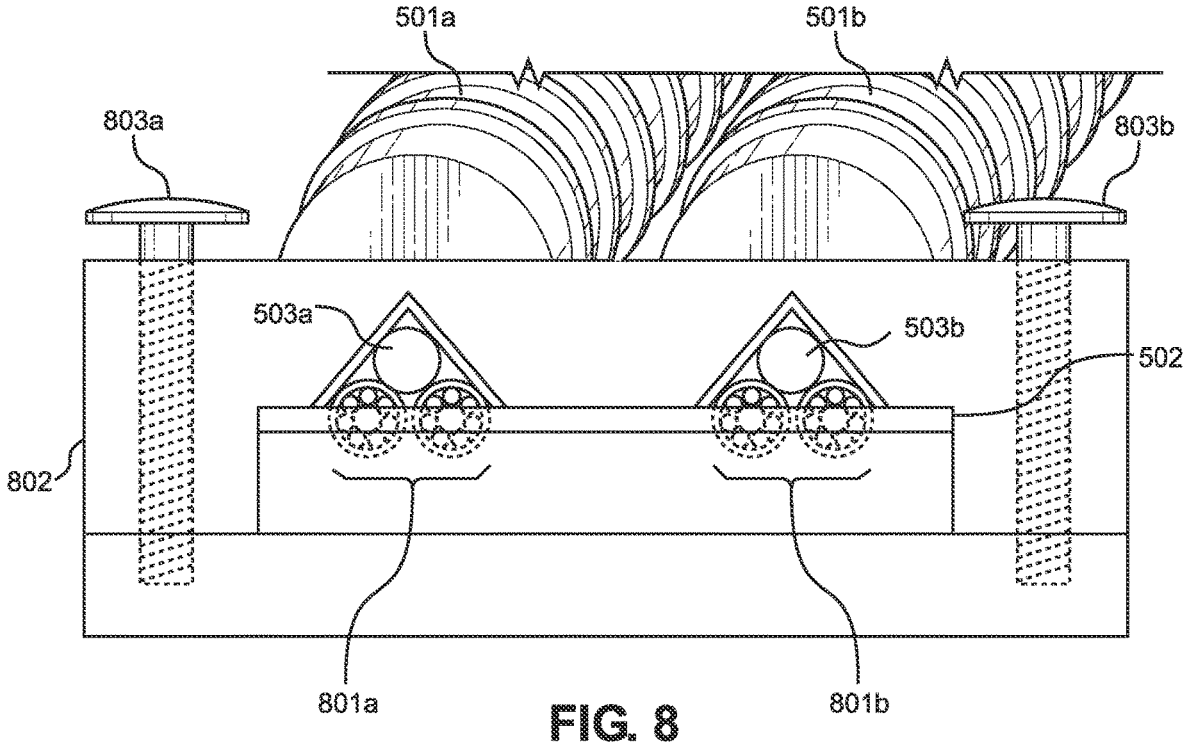
FIG. 8 shows a side perspective view of an embodiment of the polishing tank, wherein the two rotors are each attached to a gear assembly to allow the two rotors to rotate during a cleaning session.

Referring now to FIG. 8, there is shown a side perspective view of an embodiment of the housing, wherein the two rotors are each attached to a gear assembly to allow the two rotors to be rotated during a cleaning session. In the shown embodiment, the rotors 501*a*, 501*b* are on the tracks 502 and further attached to bearing assemblies 801*a*, 801*b*. Each bearing assembly 801*a*, 801*b* can include at least two bearings placed close together on each side of the rotor (501*a* or 501*b*), such that the rotor is configured to rotationally sit atop of the at least two bearings. This will allow the rotor (501*a* or 501*b*) to freely rotate as the gear assembly is spun. In the illustrated embodiment, the bearings comprise a bearing housing wherein the bearing housing is movably disposed upon the tracks 502. As such, the bearing assemblies will be securable to the tracks 502 while allowing rotation of the drive shafts 503*a*, 503*b* of the rotors 501*a*, 501*b* therein.

In one embodiment, the bearing assemblies 801*a*, 801*b* can be slidably attached to the tracks 502. In this embodiment, the bearing assemblies 801*a*, 801*b* slide along the tracks 502 and are locked into place to ensure that the rotors 501*a*, 501*b* stay in position as they are polished. Different sized rotors 501*a*, 501*b* may have different diameters. This allows for different sized rotors 501*a*, 501*b* to be placed within the housing, because the bearing assemblies 801*a*, 801*b* can be moved closer together or further apart to ensure a proper clearance.

In one embodiment, one of the bearing assemblies is permanently locked into place to provide an outermost location for a particular rotor to be placed. This ensures that there is a minimum clearance between the rotor and a sidewall of the housing.

Further, in FIG. 8, the rotors 501*a*, 501*b* are depicted as locked into place by a lock bar 802 placed over a portion of each of the rotors 501*a*, 501*b*. This ensures that the rotors 501*a*, 501*b* do not lift off the bearing assemblies. A bearing assembly may be a series of one or more bearings rotatably placed on the tracks to allow the rotors to be placed thereon. In one embodiment there are additional bearing assemblies placed on the lock bar 802 in order to ensure that the rotors freely rotate. Because different sized rotors will have different diameters, the lock bar 802 can be adjustable to accompany different sized rotors.

In the shown embodiment, the lock bar 802 can be tightened onto the rotors via a pair of bolts (803*a*, 803*b*), placed on either or both ends of the rotors 501*a*, 501*b*. This configuration allows the operator to tighten the lock bar 802 only as much as needed for various sized rotors. This means that a single uniform lock bar can be used for various different sized rotors.

Figure 9:
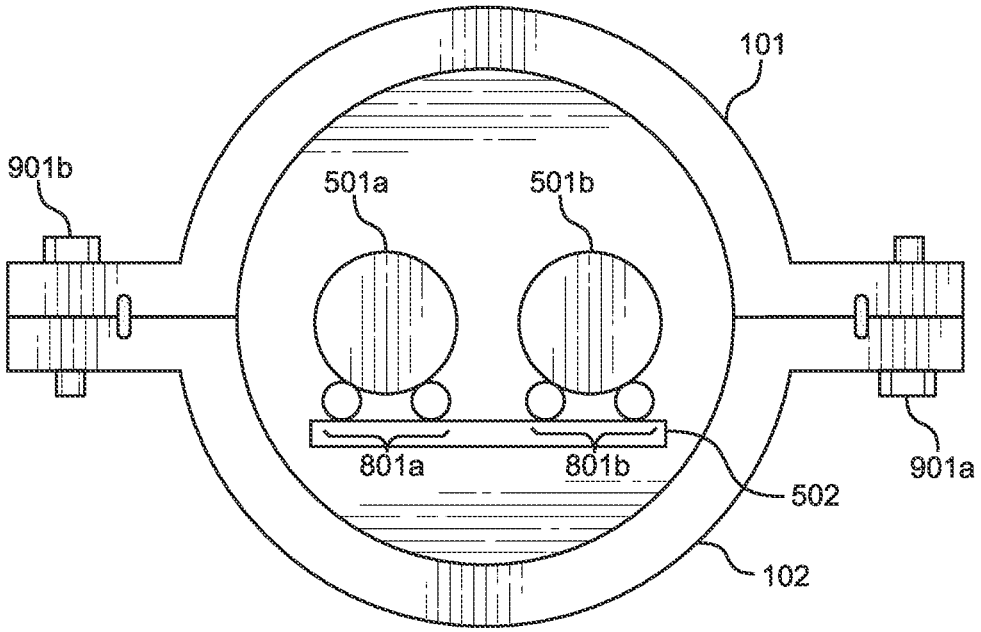
FIG. 9 shows side cross sectional view of an embodiment of the polishing tank, wherein the polishing tank includes a track for securing the two rotors in place.

Referring now to FIG. 9, there is side cross sectional view of an embodiment of the polishing tank, wherein the polishing tank includes a track for securing the two rotors in place. In the shown embodiment, the rotors 501*a*, 501*b* are placed on the tracks 502 and bearing assemblies 801*a*, 801*b* inside the closed polishing chamber. Further can be seen an embodiment where the top section 101 and the bottom section 102 are in a closed position, and held closed using bolts 901*a*, 901*b*. In this manner, the top section 101 may be completely removed from and secured to the bottom section 102 to facilitate access to an interior of the housing.

Figure 10:
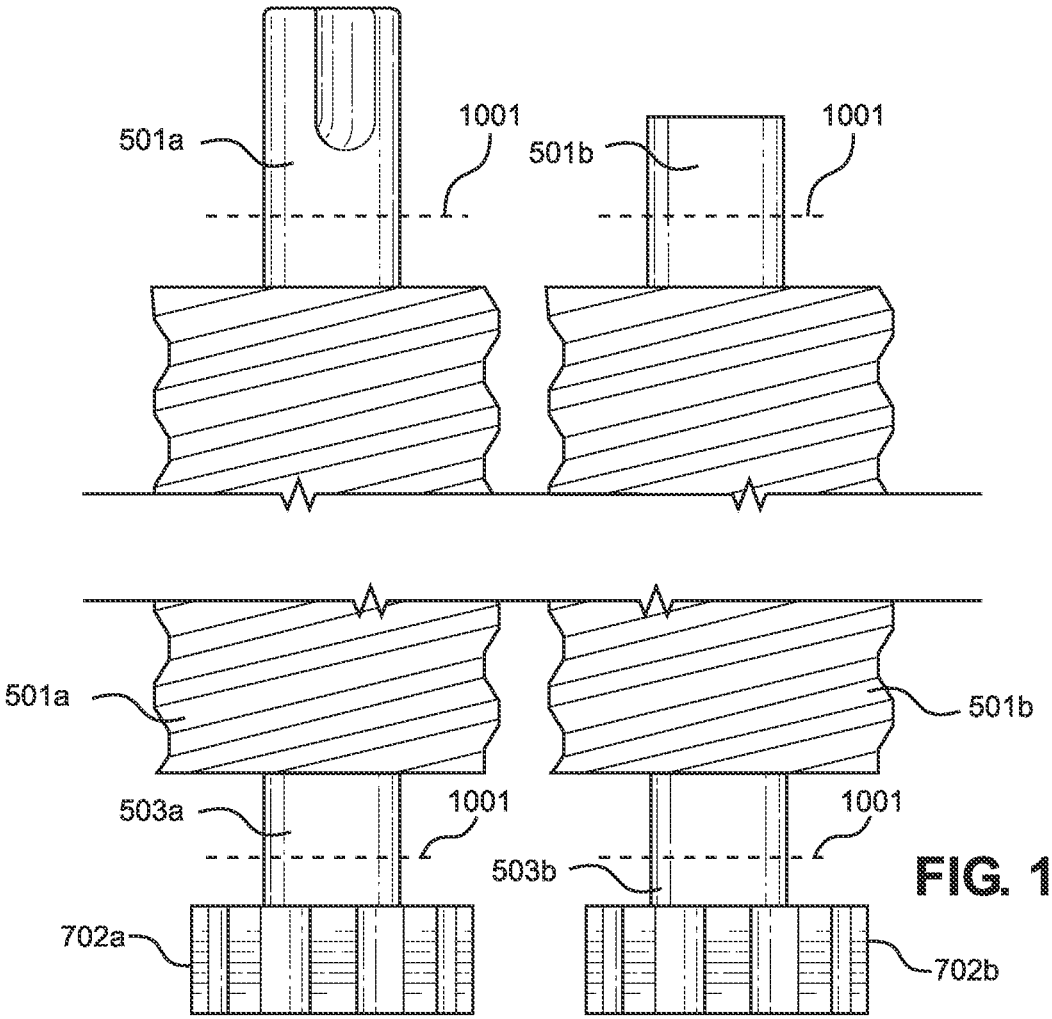
FIG. 10 shows a top cutaway view of the pair of rotors before being placed in the polishing tank.

Referring now to FIG. 10, there is shown a top cutaway view of the pair of rotors before being placed in the housing. In the shown embodiment, the rotors are attached to a gear 702*a*, 702*c* and the possible locations of where the bearing assembly may sit 1001 when rotors are installed. The gears 702*a*, 702*c* can be attached to the ends of the rotors 501*a*, 501*b* before they are placed in the housing. This allows the operator to easily attach the gears 702*a*, 702*c* without having to do so in the confined space of the housing. In this embodiment, gears 702*a*, 702*c* are only shown on a single end of the rotors 501*a*, 501*b* to allow for different length drive shafts 503*a*, 503*b* to be accepted. There are dotted lines 1001 placed across the drive shafts 503*a*, 503*b* of the rotors to exemplify a possible alignment of the bearing assemblies when the rotors 501*a*, 501*b* are then placed into the polishing chamber.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A rotor polishing device, comprising:

a housing configured to transition between an open configuration and a closed configuration;

first and second tracks, wherein the first track is internally disposed on a first side of the housing and the second track is internally disposed on a second side of the housing opposite the first track;

four bearing assemblies, wherein a first and a second bearing assembly of the four bearing assemblies are disposed on the first track, and a third and a fourth bearing assembly of the four bearing assemblies are disposed on the second track such the first bearing assembly on the first track and the third bearing assembly on the second track are opposite one another and form a first pair of bearing assemblies and the second bearing assembly on the first track and the fourth bearing assembly on the second track are opposite one another and form a second pair of bearing assemblies; wherein at least one of the first and second pair of bearing assemblies are movably affixed to the tracks and wherein each of the first and second pair of bearing assemblies are configured to receive a driver shaft of a first and second rotor, respectively;

a motor is in operable connection with a belt drive and a rod, such that the motor will drive the belt drive and turn the rod;

the rod is in operable connection with a first and a second gear assembly, the first gear assembly is in connection with the first rotor, the second gear assembly is in connection with the second rotor, such that when the motor is activated, the belt drive will rotate the rod which will rotate the first and second gear assemblies that will rotate the first and second rotors upon the respective first and second pair of bearing assemblies;

wherein a lapper substance is disposable within the housing to polish the rotating rotors.

2. The polishing device of claim 1, wherein the motor is a variable speed motor.

3. The polishing device of claim 1, wherein the motor can rotate the first and second rotors in a forward direction and in a reverse direction.

4. The polishing device of claim 1, wherein the housing includes a window thereon.

5. The polishing device of claim 1, wherein at least one of the first and second pair of bearing assemblies is stationary on the tracks.

6. The polishing device of claim 1, wherein the housing includes a drain valve thereon, wherein the drain valve is configured to enable a substance to vacate the housing during use.

7. The polishing device of claim 1, wherein an airtight seal is formed when the housing is in the closed configuration.

8. The polishing device of claim 1, wherein the first and second pair of bearing assemblies and the first and second tracks are positioned to define a clearance between the first and second rotors.

9. The polishing device of claim 1, wherein the first and second pair of bearing assemblies are positioned such that the first rotor is parallel to the second rotor when placed into the first and second pair of bearing assemblies, respectively.

10. The polishing device of claim 1, further comprising a plurality of spray nozzles attached to an interior of the housing, wherein the lapper substance can be sprayed onto the first and second rotors by an action of the plurality of spray nozzles.

11. The polishing device of claim 10, further comprising a lapper pump, wherein the plurality of spray nozzles is in fluid connection with the lapper pump, such that the lapper substance can be pumped from an exterior of the housing to the interior of the housing.

12. The polishing device of claim 11, wherein the lapper pump is configured to pump the lapper substance such that the lapper substance may have a variable pressure.

* * * * *